US007308740B2

(12) United States Patent
Roberts

(10) Patent No.: US 7,308,740 B2
(45) Date of Patent: Dec. 18, 2007

(54) URN WITH INTERCHANGEABLE DECORATIVE PANEL

(76) Inventor: James H. Roberts, 1630 San Miguel Canyon Rd., Prunedale, CA (US) 95076

( * ) Notice: Subject to any disclaimer, the term of this patent is extended or adjusted under 35 U.S.C. 154(b) by 335 days.

(21) Appl. No.: 11/053,264

(22) Filed: Feb. 7, 2005

(65) Prior Publication Data

US 2006/0174461 A1 Aug. 10, 2006

(51) Int. Cl.
*A61G 17/00* (2006.01)

(52) U.S. Cl. ..... 27/1

(58) Field of Classification Search ..... 27/1, 27/35; D99/5; 40/725, 722, 124.5
See application file for complete search history.

(56) References Cited

U.S. PATENT DOCUMENTS 3,167,844 A * 2/1965 Bachofner ..... 27/1
D268,374 S * 3/1983 Dercks et al. ..... D99/5
D268,623 S * 4/1983 Dercks et al. ..... D99/5
D272,577 S * 2/1984 Dercks et al. ..... D99/5
4,648,162 A * 3/1987 Daino ..... 27/1
5,230,127 A * 7/1993 Zukowski et al. ..... 27/1
5,287,603 A * 2/1994 Schorman ..... 27/1
5,740,637 A * 4/1998 Snow ..... 52/136
D440,735 S * 4/2001 Robinson ..... D99/28
6,295,705 B1 10/2001 Gersten
6,944,921 B1 * 9/2005 Gersten ..... 27/1
7,043,803 B2 * 5/2006 Chen ..... 27/1

* cited by examiner

*Primary Examiner*—William L. Miller
(74) *Attorney, Agent, or Firm*—Michael A. Guth

(57) ABSTRACT

An urn with a removable and replaceable panel which allows for placement of an image, such as by laser engraving, to be done on the removable panel. The panel may be custom engraved and added to a partially complete urn.

25 Claims, 10 Drawing Sheets

URN WITH INTERCHANGEABLE DECORATIVE PANEL

BACKGROUND OF THE INVENTION

1. Field of Invention

The present invention is related generally to the field of receptacles and more particularly to an urn which is adapted to contain the cremated remains of a pet or human.

2. Description of Related Art

The cremation of the mortal remains of living creatures, such as pets, has become increasingly popular. This increasing popularity may be because of a change in demographics, and it is less expensive than in ground burials. The result of the cremation process is a volume of bone fragments which are normally reduced to a fine ash by grinding, resulting in about one cubic inch of cremated remains per pound of body weight.

Some pet owners, or family or friends, choose to retain the cremated remains (also known as cremains) as a memory of the departed loved one. Typically, cremation urns take the form of a vase or a similar type of container where the cremains of the lost loved one are to be placed.

There is an accelerating trend in the afterlife industry towards personalizing the funeral products purchased for the deceased. Rather than providing plastic or tin box urns, for example, such personalizing may include an image remembrance, and in some cases this image is customized to be or contain a photograph of the deceased, or, for animals, an image that includes a breed depiction of the pet in a choice of settings, for example, a farm, country, beach, or mountain setting.

The images can be engraved onto a wooden urn using a CO2 laser. In order to maintain inventory of a large variety of images of different breeds in various size urns and types of woods, many urns would need to be engraved and stored. Occasionally, an engraving may be rejected because of deficiencies in the image, or misplacement of the image. This rejection causes a relatively expensive solid hardwood urn to be scrapped.

What is called for is an urn that can be custom engraved, and easily re-engraved in case of error without scrapping an entire urn. What is also called for is an urn which allows for a reduced inventory yet allows for prompt delivery to grieving loved ones.

BRIEF SUMMARY OF THE INVENTION

An urn with a removable and replaceable panel(s) which allows for placement of an image, such as by laser engraving, on a removable panel. The panel may be custom engraved and added to a partially complete urn.

DETAILED DESCRIPTION

Figure 1:
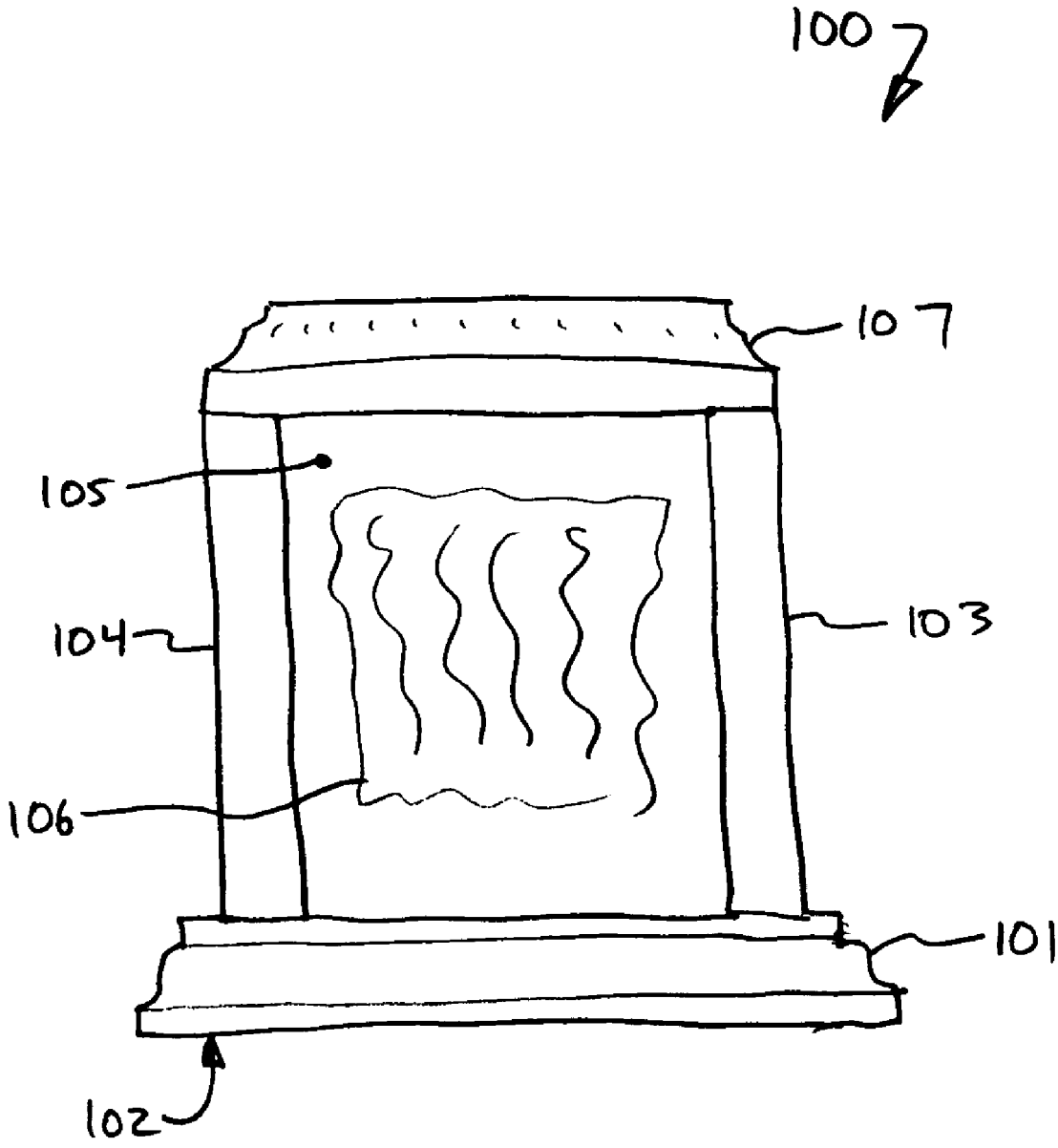
FIG. 1 is a front view of an urn according to some embodiments of the present invention.

FIG. 1 illustrates an urn 100 according to some embodiments of the present invention. The bottom surface 102 of the urn base 101 is adapted to rest upon on a flat surface. The side panels 103, 104 are in substantial contact with the base 101 along their bottom edges. In some embodiments, the side panels 103, 104 are wood and are substantially rectangular in shape. In some embodiments, the side panels 103, 104 are substantially parallel to each other. The urn front panel 105 resides between the side panels 103, 104 as viewed from the front. An image 106 is seen on the front panel 105 in some embodiments. In some embodiments, the front panel is made of wood and the image is a laser engraved image. In some embodiments, the front panel may consist of marble, granite, acrylic, or other suitable materials. The image on the front panel may be a custom image intended to memorialize the pet or person whose remains reside within. The top portion 107 covers over the top of the box created by the front, side, and rear panels.

Figure 2:
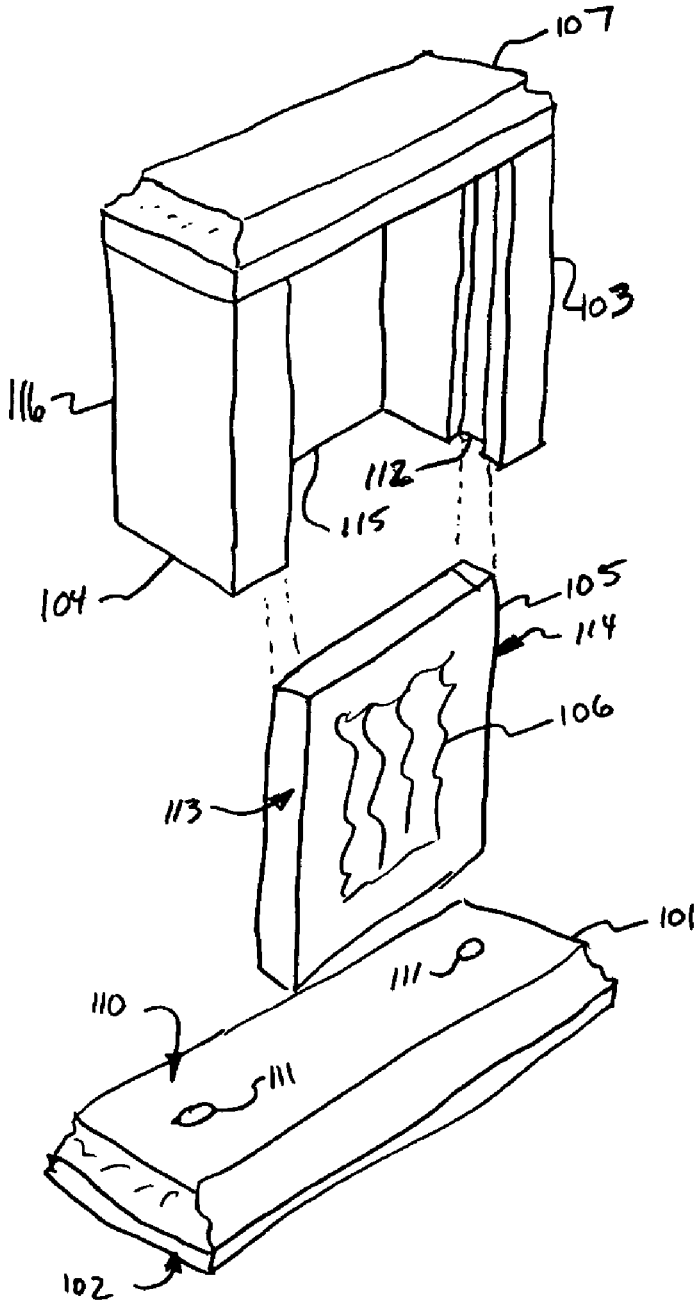
FIG. 2 is an exploded perspective view of an urn according to some embodiments of the present invention.
Figure 10:
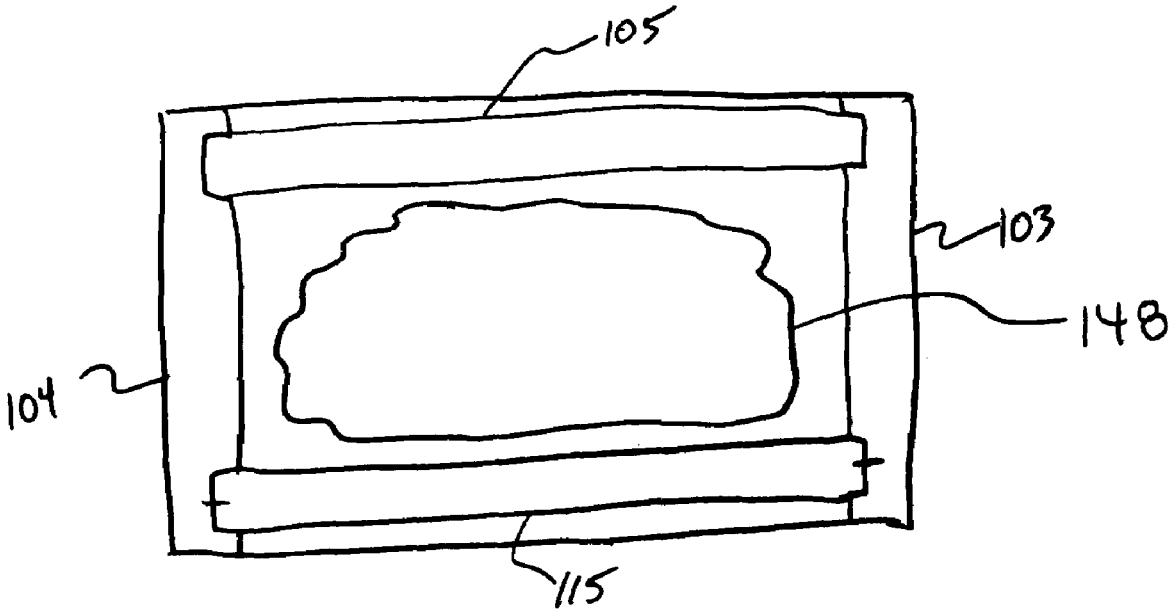
FIG. 10 is a bottom view of an urn body including a four-sided box with a removable additional panel and cremains according to some embodiments of the present invention.

FIG. 2 illustrates an exploded view of an urn according to some embodiments of the present invention. The bottom surface 102 of the base 101 is adapted to lay on a flat surface in some embodiments. Holes 111 in the base 101 are used for attaching the base 101 to the urn body 116. Screws are used to attach the base 101 to the side panels 103, 104. The screws may come up through the base 101 and thread into threaded inserts in the side panels, or they can be threaded directly into the side panels. The top portion 107, the side panels 103, 104, and the back portion 115 may be pre-assembled into the urn body 116. The front panel's sides 113, 114 may be inserted into slots 112, 120 in the side panels. In some embodiments, the front panel 105 slides into the urn body from the bottom. In some embodiments, the front panel 105 fits snugly into the slots 112, 120, and is sized so that it just fits vertically within the space between the top portion 107 and the base 101. In some embodiments, the front panel has slots in it which fit into guides on the side panels. The front panel 105 is easily removable and replaceable. The top surface 110 of the base 101 then captures and retains the front panel 105 when the base 101 is attached to the urn body 116. In some embodiments, the top surface 110 of the base 101 is substantially flat. In some embodiments, the top surface 110 of the base 101 may be recessed for the urn body and front panel. With the front panel in place and the base attached, the urn becomes a closed receptacle which can be used for the remains of a cremated pet in some embodiments. Typically, the remains will be in a separately sealed bag. As seen in FIG. 10, the remains (cremains) 148, typically in a sealed bag, reside within the urn. The front panel 105 is adapted to be easily removed from the urn body 116 when the base 101 is removed.

In some embodiments, the front panel will have an image 106. In some embodiments, the image 106 will be an engraved image. In some embodiments, the image 106 will be engraved by a laser. In some embodiments, the image may be engraved using other methods, or may be marked using another method. The image on the front panel may be customized to suit the desires of a purchaser. Because of the multitude of possible images, the front panel may be engraved as one of the last steps in the assembly process. For example, distributors may have an inventory of urns without front panels permanently attached. When an urn is desired with a particular image, a front panel may be engraved separately and inserted after engraving. The engraving of the front panel separately from the rest of the urn has many advantages. If the image is not engraved properly, the image may be re-engraved on the other side of the front panel, so that the front panel does not need to be scrapped. The image may also be re-engraved on another replacement front panel. In this case, the entire urn does not have to be discarded. In either case, the easily removable and replaceable front panel allows for economy of inventory, and allows for a manufacturing error in engraving to be absorbed without wasting a potentially expensive urn. In addition, the engraving of only the substantially flat and rectangular front panel, as opposed to an engraving process where the entire and bulky urn is placed in the engraver if the engraving is done on a panel already assembled into an urn, may allow for a much easier, accurate, and controllable engraving process. Utilizing such a system, an afterlife service and product provider may be able to keep a reduced inventory of plain (unengraved) urns. When an order for a custom engraving is received, the front panel may be manufactured and then easily mailed to the provider, where the cremains are added and it is then assembled into a completed unit. The expedited delivery of only the decorative panel allows for the use of inexpensive overnight delivery in a padded envelope, for example, as opposed to a much longer delivery time for a parcel with an entire urn.

Figure 9:
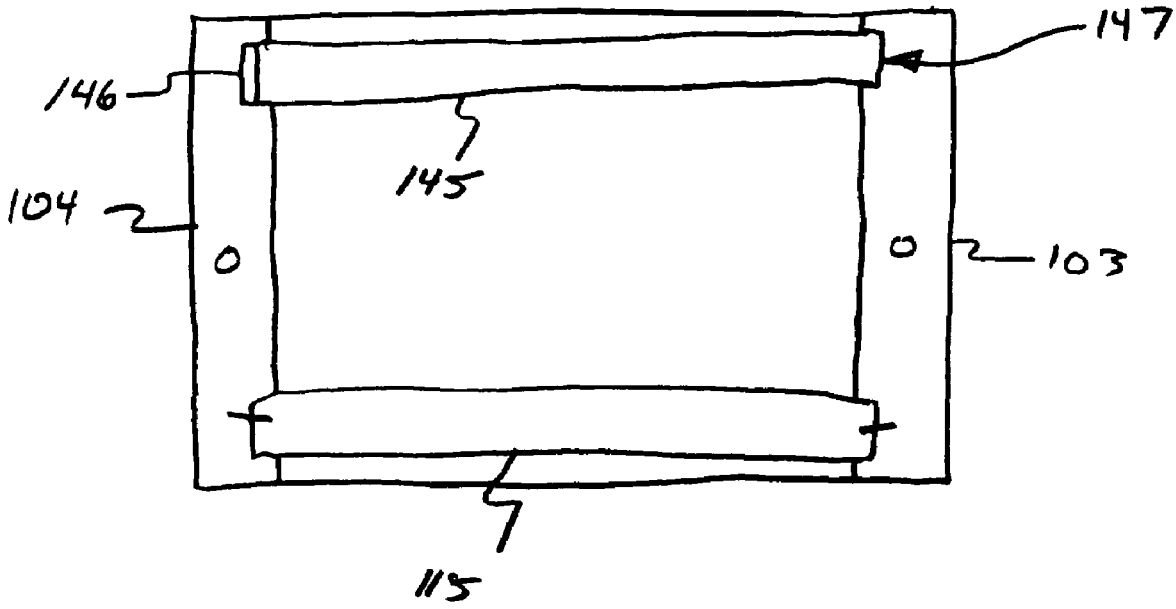
FIG. 9 is a bottom view of an urn body including a four-sided box with a removable additional panel and a shim according to some embodiments of the present invention.

In some embodiments, the image on the front panel of the urn may be of acceptable image quality such that it is not rejected on that basis, but may be off-center horizontally. In such a case, as seen in FIG. 9, the edge 147 of the panel 145 may be removed by planing or other methods. A shim 146 of appropriate thickness may be inserted into the slot where the other side of the panel resides in order to maintain the snug fit of the now centered panel.

Figure 3:
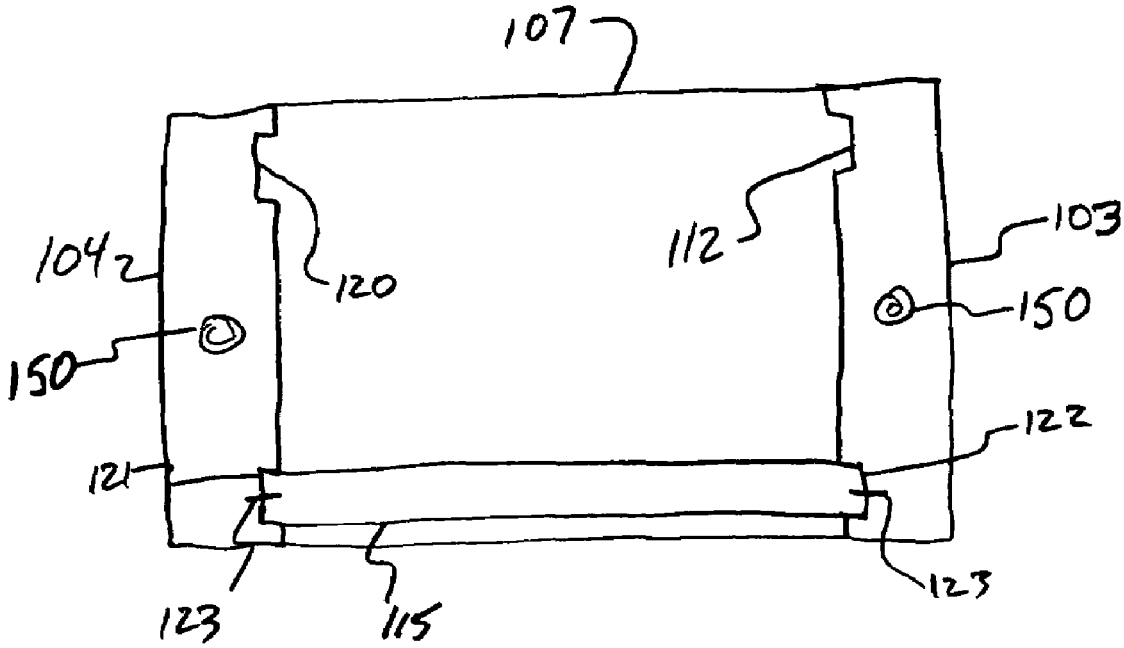
FIG. 3 is a bottom view of an urn body according to some embodiments of the present invention.

In some embodiments, as seen in bottom view in FIG. 3, an urn body has a two side panels 103, 104. The side panels 103, 104 have slots 112, 120 for the later insertion of a front panel. The rear portion 115 has been more permanently affixed into slots 121, 122 in the rear portion of the side panels 103, 104. Slats 123 may be used to fasten the rear portion 115 in some embodiments. In some embodiments, the rear portion 115 is a single panel. In some embodiments, the rear portion is an assembly of pieces. The top portion 107 is affixed to the tops of the rear portion 115 and the side panels 103, 104. In some embodiments, the top portion is affixed using adhesives. In some embodiments, the rear portion is affixed to the side panels with adhesives. In some embodiments, the base is attached to the urn body with threaded fasteners. The fasteners may come up through the bottom of the base and into threaded keepers 150 in the side panels 103, 104.

Figure 4:
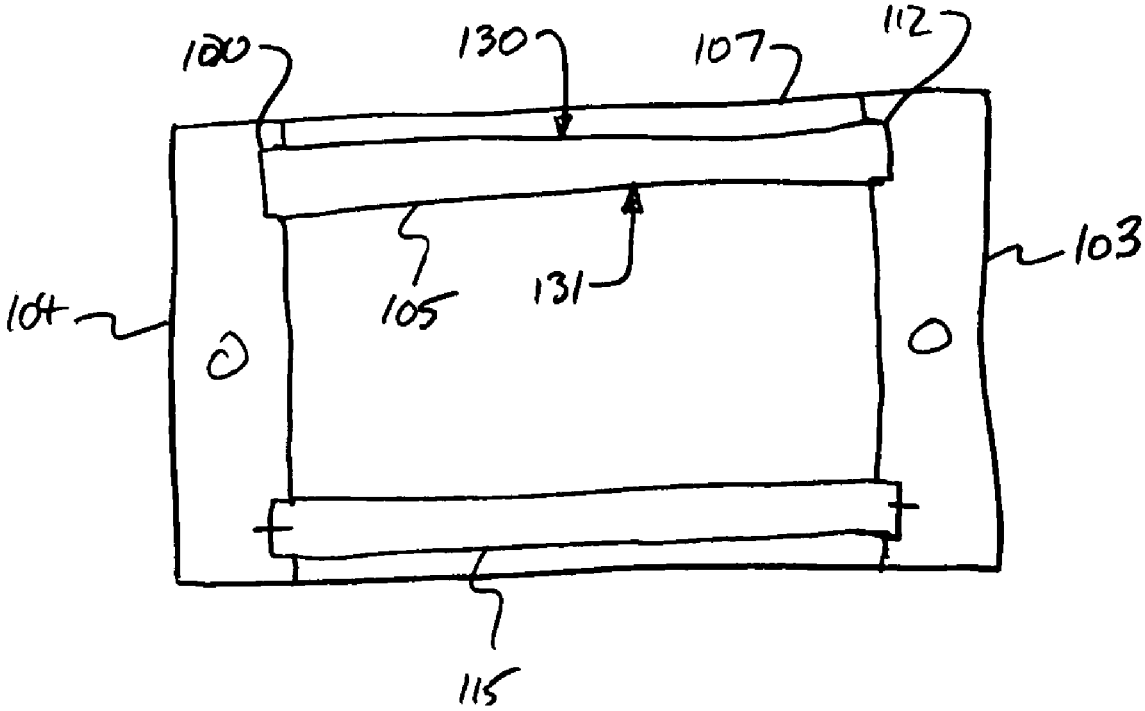
FIG. 4 is a bottom view of an urn body including a removable panel according to some embodiments of the present invention.

FIG. 4 is a bottom view of an urn body with a front panel 105 inserted. A first side 130 and a second side 131 of the front panel 105 may be used for the engraving of an image. In some embodiments, the front panel 105 is made of wood. In some embodiments, the image is engraved on the front panel 105 with a laser. An image may be engraved on the first side 130 of the front panel 105 prior to the insertion of the front panel 105 into the urn body. If, upon inspection, the image on the front panel does not meet standards when the urn is assembled, the urn may be disassembled and the front panel may be re-used on the second side 131. The urn may then be re-assembled with the second side 131 facing outwards. In some cases, the front panel may be manufactured with a different view on each side, allowing the customer to select which image is preferred upon review. For example, a breed may have both long ears and cropped ears. An image of each may be engraved, one on each side of the panel. The chosen depiction may be displayed when the urn is fully assembled, without delaying the engraving process and the delivery of the panel.

Figure 5:
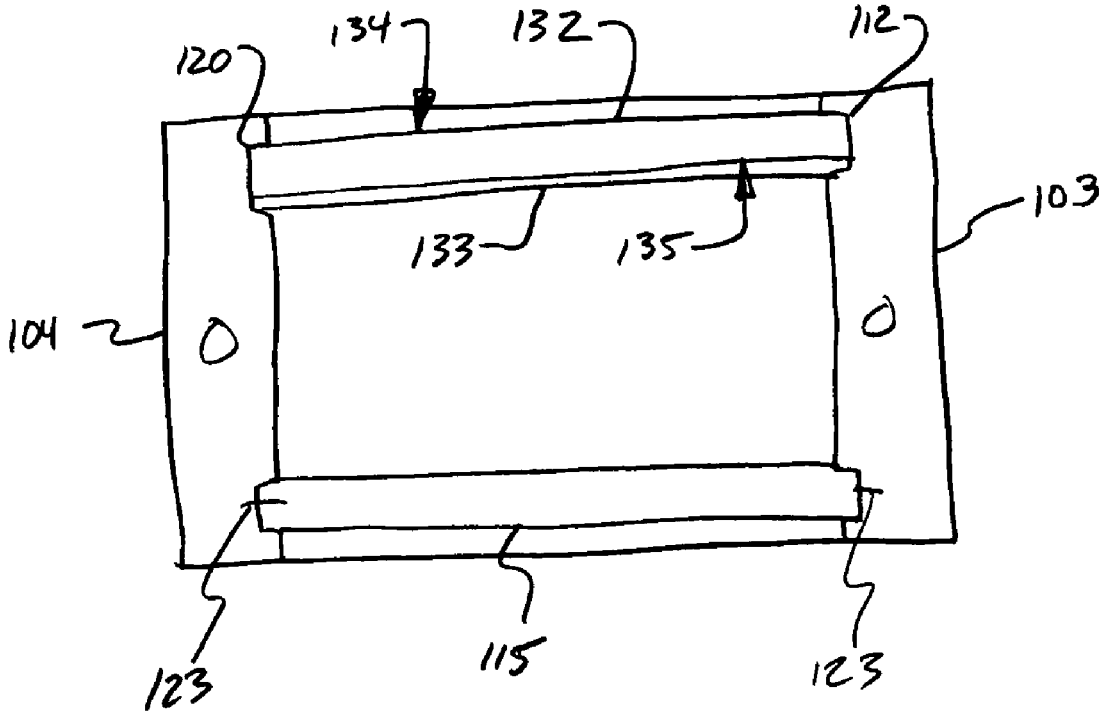
FIG. 5 is a bottom view of an urn body including a removable panel/clear pane combination according to some embodiments of the present invention.
Figure 6:
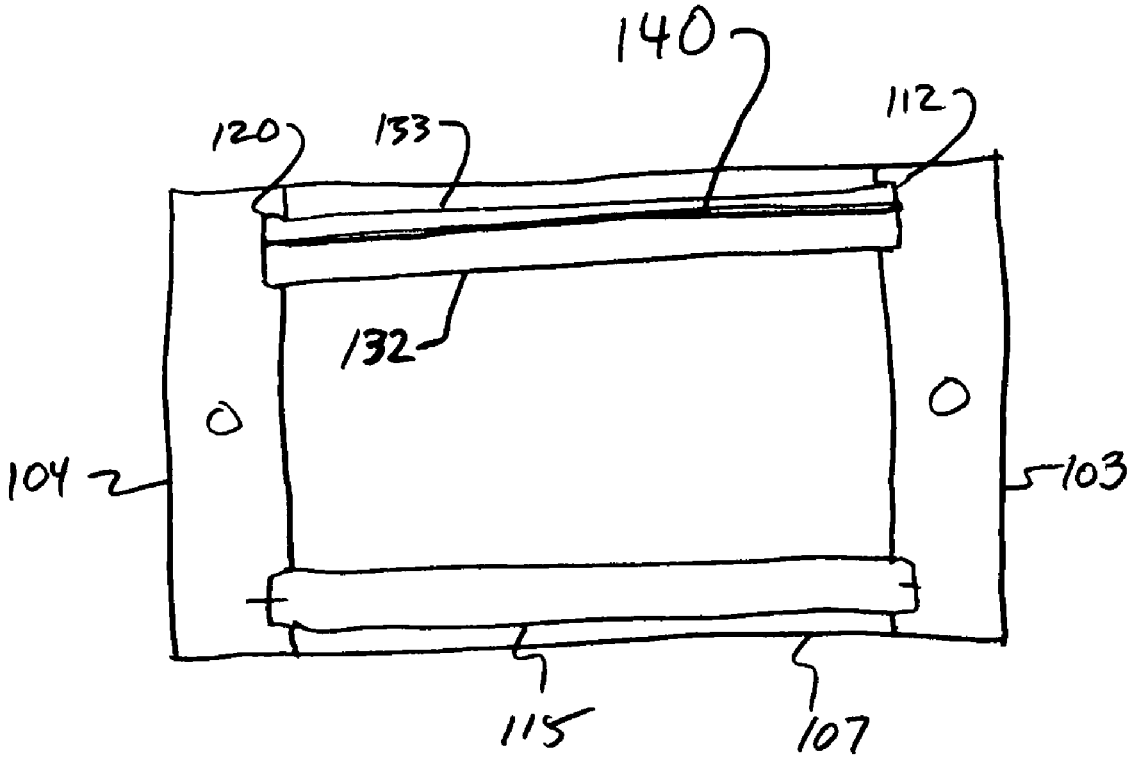
FIG. 6 is a bottom view of an urn body including a removable panel/clear pane combination according to some embodiments of the present invention.

In some embodiments, as seen in bottom view in FIGS. 5 and 6, the slots 112, 120 in the side panels 103, 104 may be adapted to seat a first partial panel 132 and a second partial panel 133. In some embodiments, the first partial panel 132 is made of wood, and the second partial panel 133 is a pane made of a clear material, such as Plexiglas. In some embodiments, the two partial panels 132, 133 are sized such that there combined thicknesses allow for a snug fit into the slots 112, 120 in the side panels, while still allowing for easy removal and replacement. The two partial panels allow for the same combination of parts to be used while offering a variety of advantages. The first partial panel 132 may be engraved on one of its surfaces 134, 135 such that an image is displayed outwardly. As in other embodiments, the first partial panel 132 may be engraved separately from the urn. Also, the first partial panel 132 may be engraved on the second surface if there is a manufacturing or other problem with the engraving on the first surface. The second partial panel 133 may be inserted on the outside of the first partial panel 132 in some embodiments. A photograph or other image 140 may be inserted between the first partial panel 132 and the second partial panel 133 and will be visible to a viewer observing the urn.

Figure 7:
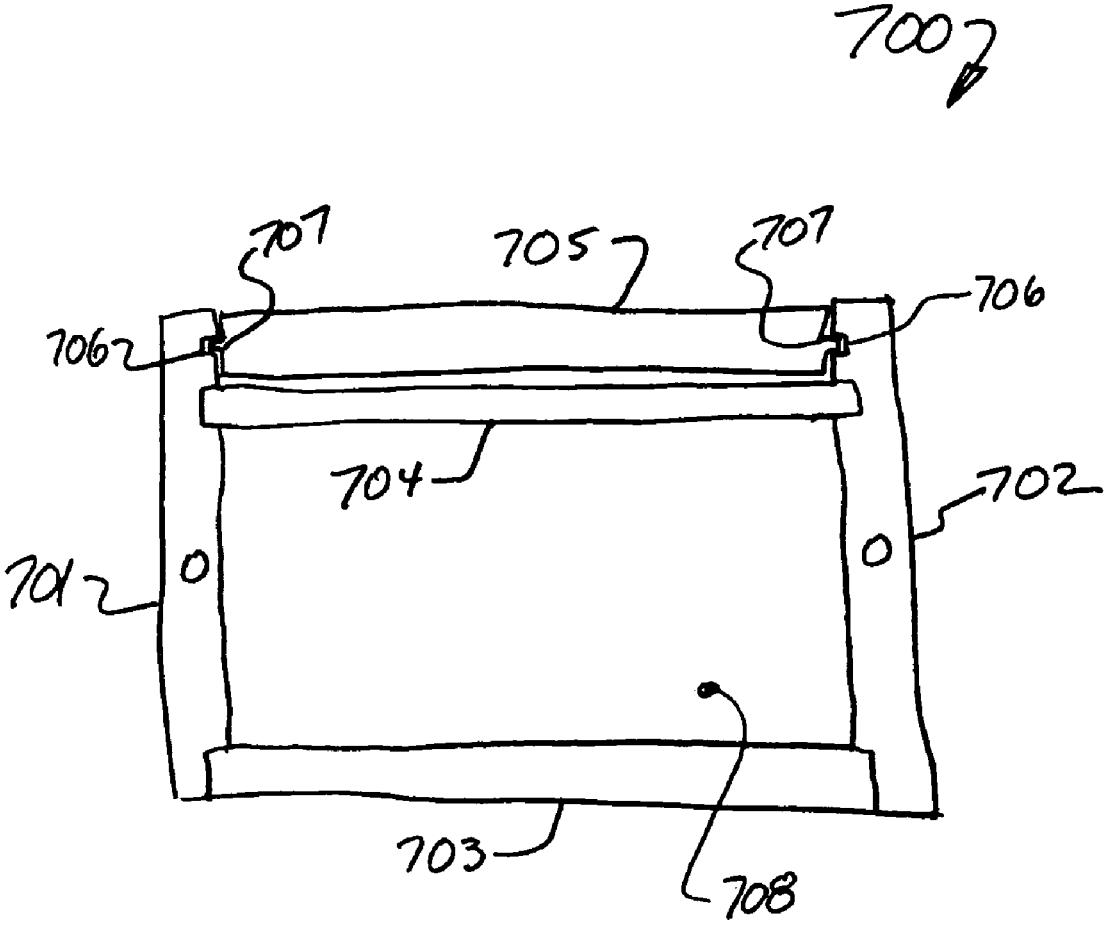
FIG. 7 is a bottom view of an urn body including a four-sided box with a removable additional panel according to some embodiments of the present invention.

In some embodiments of the present invention, as seen in FIG. 7, an urn 700 is shown in bottom view without its base. Two side panels 701, 702 are joined to a back panel 703. In some embodiments, the back panel 703 is made from one or more pieces of wood or other suitable material. A top panel 708 resides on the top of the box assembly.

A front panel 704 is attached to the two side panels 701, 702. The side panels 701, 702 extend past the front panel. A removable panel 705 with guides 707 slides into slots 706 in the side panels 701, 702. In some embodiments, the slots may be in the removable panel. An image may be engraved on either surface of the removable panel 705.

Figure 8:
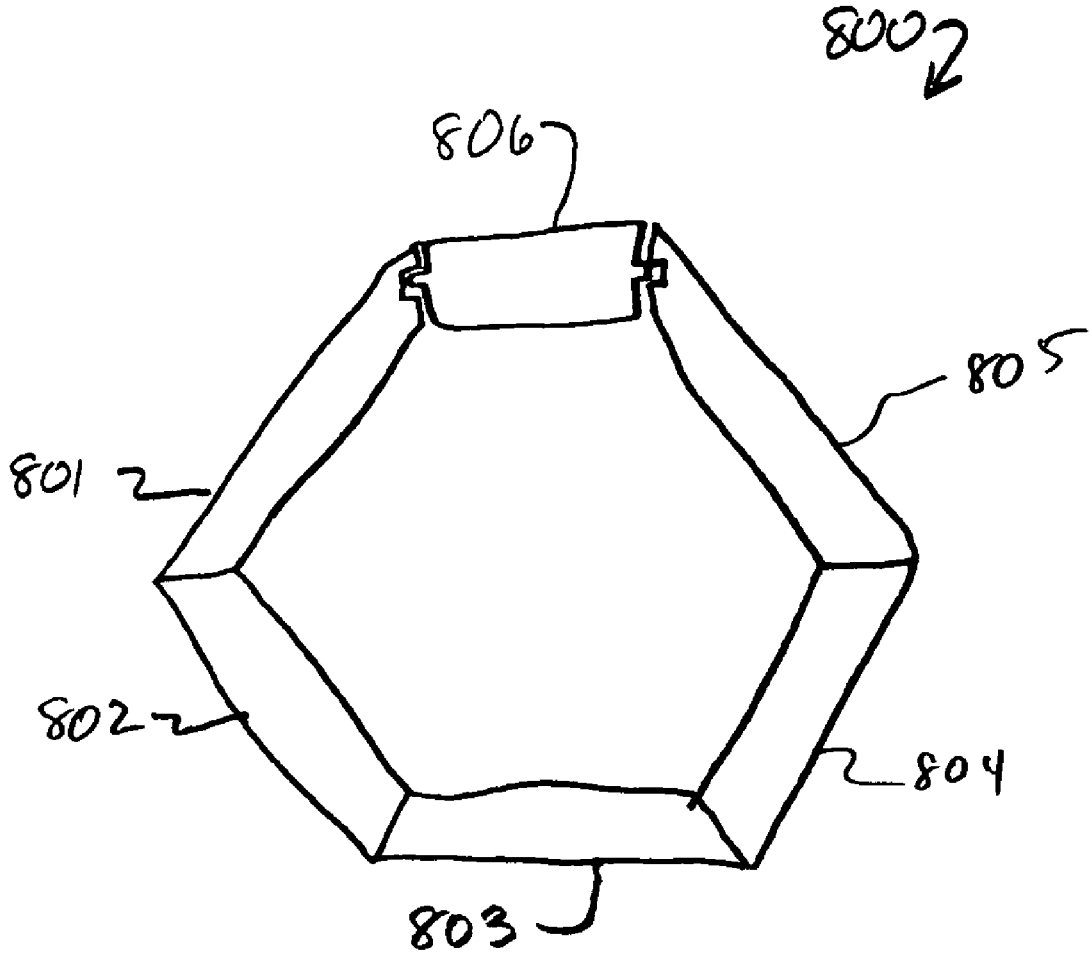
FIG. 8 is a bottom view of a multi-sided urn body with a removable additional panel according to some embodiments of the present invention.

In some embodiments of the present invention, as seen in FIG. 8, the urn body is multi-sided. An urn 800 has a plurality of panels 801-805 joined together to form an urn body. A removable panel 806 is adapted to slide into the urn body. The removable panel is adapted to be captured by the base when the base is attached to the urn body.

As evident from the above description, a wide variety of embodiments may be configured from the description given herein and additional advantages and modifications will readily occur to those skilled in the art. The invention in its broader aspects is, therefore, not limited to the specific details and illustrative examples shown and described. Accordingly, departures from such details may be made without departing from the spirit or scope of the applicant's general invention.

I claim:

1. An urn for storing cremains, said urn comprising:

an urn body, said urn body comprising:

a first side panel, said first side panel having a inside face facing the interior of said urn body;

a second side panel, said second side panel having an inside face facing the interior of said urn body;

a back portion, wherein said back portion is joined to said first side panel and to said second side panel;

a top portion, said top portion joined to the top of said side panels and said back portion;

a bottom edge at the bottom of said urn body;

a front panel portion, said front panel portion adapted to fit with said urn body to form a fourth side of a box structure, wherein said first side panel, said second side panel, and said back portion define a first, second, and third side, respectively, of said box structure; and a base, said base adapted to fasten to the bottom of said urn body, said base adapted to capture said front panel portion when fastened to said urn body, whereby with said front panel portion and said base attached to said urn body, said urn is a closed receptacle for storing said cremains; and wherein said first side panel comprises a first slot along its inside face, and wherein said second side panel comprises a second slot along its inside face, and wherein said first slot and said second slot extend to said bottom edge of said urn body, said first slot and said second slot adapted to capture two opposing sides of said front panel portion.

2. The urn of claim 1 wherein the outer periphery of said two opposing sides of said front panel portion are adapted to fit within said first and said second slots.

3. The urn of claim 1 wherein said front panel portion is easily removable and replaceable.

4. The urn of claim 3 wherein said front panel portion is adapted to be inserted with either its front or rear side facing outwards.

5. The urn of claim 3 further comprising said cremains, said cremains contained within said urn.

6. The urn of claim 3 wherein said front panel portion is adapted to be removed from said urn by removing said base.

7. The urn of claim 3 wherein said front panel portion comprises an image.

8. The urn of claim 7 wherein said image is engraved on a surface of said front panel portion.

9. The urn of claim 7 wherein said image is laser engraved on a surface of said front panel portion.

10. The urn of claim 8 wherein said front panel portion comprises a wood panel.

11. The urn of claim 1 wherein said front panel portion comprises an image.

12. The urn of claim 11 wherein said image is engraved on a surface of said front panel portion.

13. The urn of claim 12 wherein said front panel portion comprises a wood panel.

14. The urn of claim 11 wherein said image is laser engraved on a surface of said front panel portion.

15. The urn of claim 11 wherein said front panel portion comprises a granite panel.

16. The urn of claim 11 wherein said front panel portion comprises a marble panel.

17. An urn for storing cremains, said urn comprising:

an urn body, said urn body comprising:

a first side panel;

a second side panel;

a back portion, wherein said back portion is joined to said first side panel and to said second side panel;

a top portion, said top portion joined to the top of said side panels and said back portion;

a front panel portion, said front panel portion adapted to fit with said urn body to form a fourth side of a box structure wherein said first side panel, said second side panel, and said back portion define a first, second, and third side, respectively, of said box structure; and a base, said base adapted to fasten to the bottom of said urn body, said base adapted to capture said front panel portion when fastened to said urn body, whereby with said front panel portion and said base attached to said urn body, said urn is a closed receptacle for storing said cremains;

wherein said front panel portion comprises:

a first partial panel; and a second partial panel, wherein said first and second side panels each include a slot, and said first and second partial panels are positioned into said slots of said side panels, wherein said slots extend to the bottom of said side panels.

18. The urn of claim 17 wherein said first partial panel comprises wood.

19. The urn of claim 18 wherein said second partial panel comprises a clear material.

20. The urn of claim 19 further comprising an image on paper, said image on paper interlayed between said first partial panel and said second partial panel.

21. The urn of claim 17 wherein said first partial panel and said second partial panel are adapted to overlay each other.

22. An urn for storing cremains, said urn comprising:

an urn body, said urn body comprising:

a first side panel;

a second side panel;

a back portion, wherein said back portion is joined to said first side panel and to said second side panel;

a front panel; said front panel joined to said first side panel and to said second side panel to form a box structure along with said back portion; wherein said first side panel and said second side panel comprise extended portions that extend beyond said front panel;

a top portion, said top portion joined to the top of said urn body;

a removable display panel portion, said removable display panel portion adapted to slide into slots in the extended portions of the first and second side panels; and a base, said base adapted to fasten to the bottom of said urn body, said base adapted to capture said display panel portion when fastened to said urn body, whereby with said base attached to said urn body, said urn is a closed receptacle for storing said cremains.

23. The urn of claim 22 wherein said display panel portion is easily removable and replaceable.

24. A method for making an urn for storing cremains, said method comprising:

engraving an image onto a panel;

inserting the panel into a box structure such that the engraved image is visible from the outside of the box structure by sliding said panel of slots of side panels of said box structure, wherein said slots extend to the bottom of said side panels; and attaching a base to the box structure wherein attaching the base captures the panel into the box structure, whereby said urn is a closed receptacle for storing said cremains.

25. The method of claim 24 further comprising inserting said cremains into the box structure.

* * * * *